US012654081B2

(12) United States Patent
Chen

(10) Patent No.: US 12,654,081 B2
(45) Date of Patent: Jun. 16, 2026

(54) SHOCK ABSORBING DEVICE

(71) Applicant: Wei-Jung Chen, Taipei City (TW)

(72) Inventor: Wei-Jung Chen, Taipei City (TW)

( * ) Notice: Subject to any disclaimer, the term of this patent is extended or adjusted under 35 U.S.C. 154(b) by 827 days.

(21) Appl. No.: 17/869,363

(22) Filed: Jul. 20, 2022

(65) Prior Publication Data

US 2023/0021604 A1 Jan. 26, 2023

(30) Foreign Application Priority Data

Jul. 22, 2021 (TW) ..... 110126982

(51) Int. Cl.

| | |
|---|---|
| ***A63B 49/00*** | (2015.01) |
| ***A63B 49/022*** | (2015.01) |
| ***A63B 49/028*** | (2015.01) |
| ***A63B 60/54*** | (2015.01) |

(52) U.S. Cl.

CPC ..... *A63B 60/54* (2015.10); *A63B 49/022* (2015.10); *A63B 49/028* (2015.10)

(58) Field of Classification Search

CPC ..... A63B 60/54; A63B 49/022; A63B 49/028; A63B 60/02; A63B 2049/0217; A63B 2209/00; A63B 2209/10; A63B 49/14; A63B 49/00; A63B 71/0054; A63B 2071/0063; A63B 2102/02–06

USPC ..... 473/474, 519–557

See application file for complete search history.

(56) References Cited

U.S. PATENT DOCUMENTS

| | | | | | |
|---|---|---|---|---|---|
| 1,697,814 | A * | 1/1929 | Forbes | F16F 1/3732 | 277/606 |
| 3,702,701 | A * | 11/1972 | Vaughn et al. | A63B 49/03 | 473/545 |
| 4,000,893 | A * | 1/1977 | Evans | A63B 69/38 | 473/437 |
| 4,165,071 | A * | 8/1979 | Frolow | A63B 49/02 | 73/65.03 |
| 4,310,157 | A * | 1/1982 | Greenberg | A63B 49/02 | 273/DIG. 23 |
| 4,765,620 | A * | 8/1988 | Janes | A63B 60/54 | 273/DIG. 8 |

(Continued)

FOREIGN PATENT DOCUMENTS

| | | | | |
|---|---|---|---|---|
| BE | 902428 A * | 9/1985 | ..... | A63B 60/02 |
| CA | 2849514 A1 * | 7/2013 | ..... | A63B 49/022 |

(Continued)

*Primary Examiner* — Kiley S Stoner

(74) *Attorney, Agent, or Firm* — Guice Patents PLLC

(57) ABSTRACT

A shock-absorbing device is applied in a ball/racket frame having a plurality of string holes allowing a string to pass, and includes: at least one or more outer tubular member, disposed at a periphery of the ball/racket frame and arranged between the string holes adjacently disposed, wherein two sides and an outer side of the outer tubular member are formed with an adhering surface and an outer tubular wall, and a bottom end of thereof is formed with an adhering part adhered at the periphery of the ball/racket frame; and an inner tubular member, disposed in the outer tubular member along an axial direction and an inner side thereof is formed with an inner tubular wall; accordingly, by providing interferences at different timings and bearing shock waves of a counter shock force generated while a ball being struck via the string, effects of absorbing shock and damping are achieved.

9 Claims, 15 Drawing Sheets

(56) References Cited

U.S. PATENT DOCUMENTS

| | | | | | |
|---|---|---|---|---|---|
| 4,828,259 | A * | 5/1989 | Davis | A63B 49/03 | 473/522 |
| 4,948,131 | A * | 8/1990 | Nakanishi | A63B 60/54 | 473/521 |
| 4,953,861 | A * | 9/1990 | Nakanishi | A63B 49/02 | 473/523 |
| 5,039,097 | A * | 8/1991 | Bartlett | A63B 60/02 | 473/519 |
| 5,158,286 | A * | 10/1992 | Soong | A63B 60/54 | 473/522 |
| 5,165,687 | A * | 11/1992 | Soong | A63B 60/54 | 473/521 |
| 5,220,719 | A * | 6/1993 | You | A63B 60/00 | 264/254 |
| 5,290,031 | A * | 3/1994 | Natsume | A63B 49/022 | 473/522 |
| 6,506,133 | B1 * | 1/2003 | Hong | A63B 49/022 | 473/522 |
| 10,004,950 | B1 * | 6/2018 | Kapheim | A63B 49/028 | |
| 2001/0044348 | A1 * | 11/2001 | Liao | A63B 60/02 | 473/524 |
| 2003/0232670 | A1 * | 12/2003 | Tsai | A63B 49/02 | 473/520 |
| 2005/0266941 | A1 * | 12/2005 | Ashino | A63B 49/02 | 473/535 |
| 2006/0252584 | A1 * | 11/2006 | Dollins | A63B 60/00 | 473/548 |
| 2009/0017948 | A1 * | 1/2009 | Ashino | A63B 49/022 | 473/522 |
| 2009/0082142 | A1 * | 3/2009 | Yu | A63B 49/022 | 473/522 |
| 2011/0039641 | A1 * | 2/2011 | Severa | A63B 49/028 | 473/541 |
| 2014/0302952 | A1 * | 10/2014 | Sommer | A63B 49/02 | 473/520 |
| 2014/0335979 | A1 * | 11/2014 | Grimes | A63B 49/022 | 473/522 |
| 2019/0126106 | A1 * | 5/2019 | Ogawa | A63B 49/02 | |
| 2022/0347535 | A1 * | 11/2022 | Chen | A63B 60/54 | |
| 2024/0091597 | A1 * | 3/2024 | Kato | A63B 49/022 | |
| 2025/0041676 | A1 * | 2/2025 | Yamashita | F16B 13/14 | |
| 2025/0177823 | A1 * | 6/2025 | Yamashita | A63B 49/022 | |

FOREIGN PATENT DOCUMENTS

| | | | | | |
|---|---|---|---|---|---|
| CN | 1663641 | A * | 9/2005 | A63B 49/02 | |
| CN | 1973924 | A * | 6/2007 | A63B 49/022 | |
| CN | 102284179 | A * | 12/2011 | A63B 49/08 | |
| CN | 103889516 | A * | 6/2014 | A63B 47/02 | |
| CN | 105148467 | A * | 12/2015 | A63B 49/02 | |
| CN | 107198866 | A * | 9/2017 | | |
| CN | 107213608 | A * | 9/2017 | | |
| CN | 108495690 | A * | 9/2018 | A63B 49/022 | |
| CN | 114515422 | A * | 5/2022 | | |
| CN | 217311850 | U * | 8/2022 | | |
| CN | 115382178 | A * | 11/2022 | A63B 49/02 | |
| CN | 115624729 | A * | 1/2023 | A63B 49/022 | |
| DE | 2724652 | A * | 12/1978 | A63B 60/02 | |
| DE | 3443009 | A1 * | 5/1986 | | |
| DE | 10010315 | A1 * | 8/2001 | A63B 60/02 | |
| DE | 20107801 | U1 * | 8/2001 | A63B 49/022 | |
| DE | 69835053 | T2 * | 1/2007 | A63B 49/022 | |
| DE | 102010023860 | A1 * | 6/2011 | A63B 49/00 | |
| EP | 0074094 | A2 * | 3/1983 | | |
| EP | 0201953 | A1 * | 11/1986 | | |
| EP | 0909572 | B1 * | 5/2003 | | |
| EP | 2036594 | A1 * | 3/2009 | A63B 49/02 | |
| EP | 2777776 | B1 * | 11/2017 | A63B 49/02 | |
| EP | 4091679 | A1 * | 11/2022 | A63B 49/022 | |
| EP | 4122558 | A1 * | 1/2023 | A63B 49/022 | |
| ES | 2699087 | T3 * | 2/2019 | A63B 43/008 | |
| GB | 2186493 | A * | 8/1987 | A63B 60/54 | |
| GB | 2391819 | A * | 2/2004 | A63B 49/02 | |
| JP | 2003144585 | A * | 5/2003 | A63B 49/03 | |
| JP | 4049636 | B2 * | 2/2008 | A63B 49/022 | |
| JP | 4187492 | B2 * | 11/2008 | A63B 49/022 | |
| JP | 2014193205 | A * | 10/2014 | A63B 49/035 | |
| JP | 2015229004 | A * | 12/2015 | A63B 49/02 | |
| JP | 3236882 | U * | 3/2022 | | |
| KR | 0579880 | A1 * | 1/1994 | | |
| KR | 200194513 | Y1 * | 9/2000 | | |
| KR | 200433661 | Y1 * | 12/2006 | | |
| KR | 102196049 | B1 * | 12/2020 | | |
| KR | 20230045557 | A * | 4/2023 | | |
| WO | WO-2009134974 | A1 * | 11/2009 | A63B 51/00 | |

* cited by examiner

SHOCK ABSORBING DEVICE

BACKGROUND OF THE INVENTION

1. Field of the Invention

The present invention relates to a device, especially to a shock absorbing device capable of interfering and bearing and damping shock waves of a counter shock force generated when a string of a ball/racket frame strikes a ball so as to reduce the shock wave being transferred to a wrist or an arm of a user.

2. Description of Related Art

A conventional racket is provided with longitudinal and transversal (defined as a Y-axis and an X-axis) strings on a racket frame of the racket, the racket frame is provided with longitudinal and transversal string holes which are symmetrically arranged on a periphery thereof, a single grommet is disposed inside the string hole, the string is disposed inside the single grommet so as to be woven for forming a racket surface having a certain pounds, the racket frame having the strings is formed as a racket which is used in various exciting ball games, for example tennis, badminton or squash; for allowing a ball to be received in a sweet spot of the racket surface, the sportsman holding the racket has to rapidly response and move and has a continuous focus, it is more important that shock waves of a counter shock force generated in an instant striking moment of the string of the racket frame being in contact with the ball may let the wrist or the arm of the sportsman feel numb, and the counter shock force and the pounds (tightness) defined when the string is tightened is in a direct ratio, in other words the higher the pounds, the greater the counter shock force, the counter shock force would be transferred to the wrist or the arm through the racket, so that sport damages, for example tennis elbow due to backhand striking or golf elbow due to positive striking, may happen because there is no shock-absorbing device provided between the strings woven on the racket frame of the conventional racket, the shock waves of the counter shock force generated when the racket surface composed of the strings being woven contacts the ball could not be absorbed and damped thereby being fully transferred to the wrist and the arm, and the racket is unable to be stably held by the sportsman, moreover, the weight of the periphery of the conventional racket frame cannot be adjusted with respect to requirements of the user; accordingly, the practicability is very much limited; as such, the above-mentioned shortages shall be improved by the skilled people in the art.

SUMMARY OF THE INVENTION

For solving the shortages existed in the prior art, one primary objective of the present invention is to provide a shock absorbing device, in which an outer tubular member of the device is structured through a soft medium and a hard medium being staggeringly arranged for being integrally formed and the periphery thereof is formed with an outer tubular wall, a bottom end of the outer tubular member is formed with an adhering part, and the outer tubular member is axially disposed with an inner tubular member served as a string passing hole and having an inner tubular member, thereby solving the shortages existed in the prior art Another objective of the present invention is to provide a shock absorbing device, in which with one or more than one of the devices are disposed at a periphery of a ball/racket frame to generate weights in different phases, and a string passing an inner tubular wall is disposed in an adjacent string hole of the ball/racket frame, thereby providing interferences at different timings and bearing shock waves of a counter shock force generated while a ball being struck via the string, and effects of absorbing shock and damping are achieved.

One another objective of the present invention is to provide a shock absorbing device, which has advantages of the structure being greatly simplified, the racket operation being safer, the stability of holding the racket being enhanced and possible sport damages being lowered The problem to be solved by the present invention is that: a conventional racket is provided with longitudinal and transversal (defined as a Y-axis and an X-axis) strings on a racket frame of the racket, the racket frame is provided with longitudinal and transversal string holes which are symmetrically arranged on a periphery thereof, a single grommet is disposed inside the string hole, the string is disposed inside the single grommet so as to be woven for forming a racket surface having a certain pounds, the racket frame having the strings is formed as a racket which is used in various exciting ball games, for example tennis, badminton or squash; for allowing a ball to be received in a sweet spot of the racket surface, the sportsman holding the racket has to rapidly response and move and has a continuous focus, it is more important that shock waves of a counter shock force generated in an instant striking moment of the string of the racket frame being in contact with the ball may let the wrist or the arm of the sportsman feel numb, and the counter shock force and the pounds (tightness) defined when the string is tightened is in a direct ratio, in other words the higher the pounds, the greater the counter shock force, the counter shock force would be transferred to the wrist or the arm through the racket, so that sport damages, for example tennis elbow due to backhand striking or golf elbow due to positive striking, may happen because there is no shock-absorbing device provided between the strings woven on the racket frame of the conventional racket, the shock waves of the counter shock force generated when the racket surface composed of the strings being woven contacts the ball could not be absorbed and damped thereby being fully transferred to the wrist and the arm, and the racket is unable to be stably held by the sportsman, moreover, the weight of the periphery of the conventional racket frame cannot be adjusted with respect to requirements of the user; accordingly, the practicability is very much limited.

For achieving the aforesaid objectives, one technical solution provided by the present invention is to provide a shock-absorbing device applied in a ball/racket frame having a plurality of string holes or disposed with single grommet allowing a string to pass, and characterized in that the device including:

- at least one or more outer tubular member, disposed at a periphery of the ball/racket frame and arranged between the string holes adjacently disposed, wherein two sides and an outer side of the outer tubular member are respectively formed with an adhering surface and an outer tubular wall, and a bottom end of the outer tubular member is formed with an adhering part adhered at the periphery of the ball/racket frame; and
- an inner tubular member, disposed in the outer tubular member along an axial direction, wherein the inner tubular member allows the string to pass and an inner side of the inner tubular member is formed with an inner tubular wall;

wherein, with a means of disposing one or more than one of the devices between the adjacent string holes of the ball/racket frame and a means of arranging weighs in different phases, the string is prohibited from being in the same horizontal plane, thereby providing interferences at different timings and bearing shock waves of a counter shock force generated while a ball being struck via the string, and effects of absorbing shock and damping are achieved.

Wherein, according to the present invention, the outer tubular member is formed in a circular shape, a rectangular shape or a polygonal shape.

Wherein, according to the present invention, the outer tubular member includes a soft medium and a hard medium staggeringly arranged to be integrally formed.

Wherein, according to the present invention, a hollow array is formed through being divided between the outer tubular member and the inner tubular member.

Wherein, according to the present invention, at least one counterweight capable of achieving an effect of absorbing shock through rotating angles is disposed between a horizontal upper end of the outer tubular member and the inner tubular member and arranged with an angle.

Wherein, according to the present invention, the outer tubular wall of the outer tubular member is formed as a rough surface or a patterned surface.

Wherein, according to the present invention, the outer tubular wall of the outer tubular member is formed as an irregular surface.

Wherein, according to the present invention, the outer tubular wall of the outer tubular member is provided with a plurality of gel-like protrusions.

Wherein, according to the present invention, the inner tubular wall of the inner tubular member is formed as an irregular surface.

Wherein, according to the present invention, the outer tubular wall of the outer tubular member and the inner tubular wall of the inner tubular member are formed as irregular surfaces.

Wherein, according to the present invention, a radial distance ratio defined between the top end of the inner tubular member and the top end of the outer tubular wall of the outer tubular member and between the bottom end of the inner tubular member and the adhering part at the bottom end of the outer tubular member is 1:1 or 1:2.

Wherein, according to the present invention, the outer tubular member is formed with at least one axially-oriented hole radially arranged at an interval defined between the adhering part and the inner tubular member.

Wherein, according to the present invention, the appearance of the outer tubular member is formed in a tubular state or in a left spiral columnar state or in a right spiral columnar state or a spiral columnar structure composed of at least one set of the left spiral columnar state and at least one set of the right spiral columnar state.

Advantages achieved by the present invention are as follows: the outer tubular member includes the soft medium and the hard medium being staggeringly arranged for being integrally formed and the periphery thereof is formed with the outer tubular wall, the bottom end of the outer tubular member is formed with the adhering part, and the outer tubular member is axially disposed with the inner tubular member served as a string passing hole and having the inner tubular wall; as such, with one or more than one of the devices being disposed at the periphery of the ball/racket frame to generate the weights in different phases, and the string passing the inner tubular wall is disposed in the adjacent string hole of the ball/racket frame for providing interferences at different timings and bearing shock waves of a counter shock force generated while a ball being struck via the string, and effects of absorbing shock and damping are achieved; moreover, the structure can be greatly simplified, the racket operation can be safer, the stability of holding the racket can be enhanced and possible sport damage can be lowered. Accordingly, the present invention can be widely applied in sport related industries and has features of being novel and nonobvious.

DETAILED DESCRIPTION OF THE PREFERRED EMBODIMENT

One preferred embodiment of the present invention will be described with reference to the drawings for illustrating the structural assembly, the technical means and the functions to be achieved by the present invention; and the actual ratios and the arrangement of components shall not be limited by the ratios and the arrangement of components in the provided figures.

Figure 1:
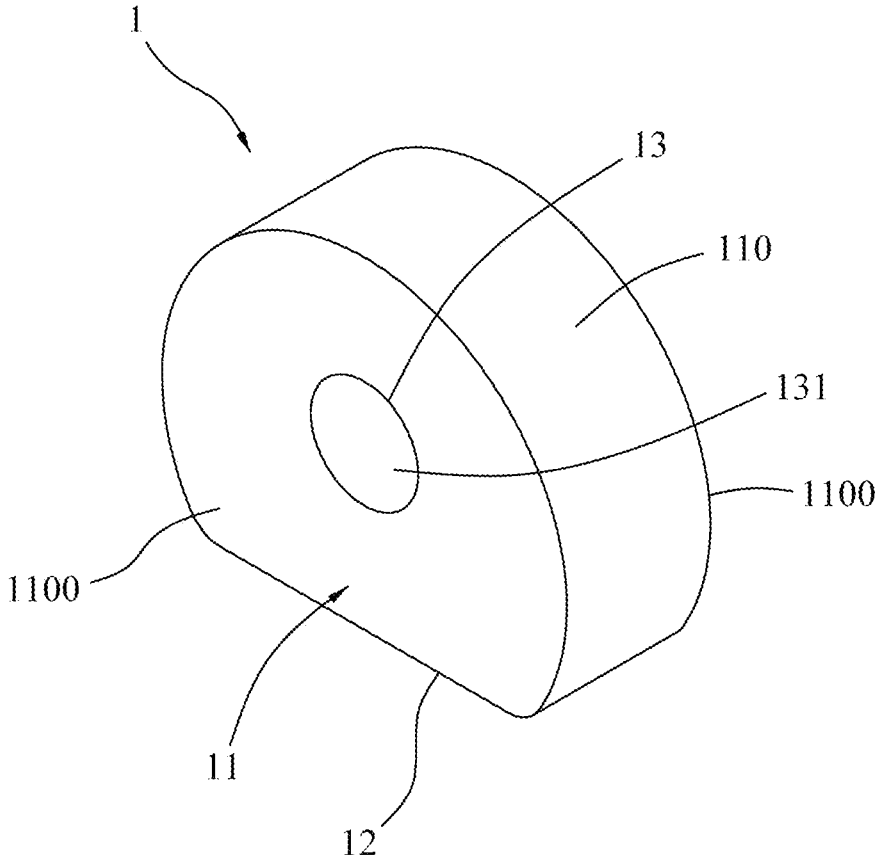
FIG. 1 is a perspective exploded view according to the present invention.
Figure 2:
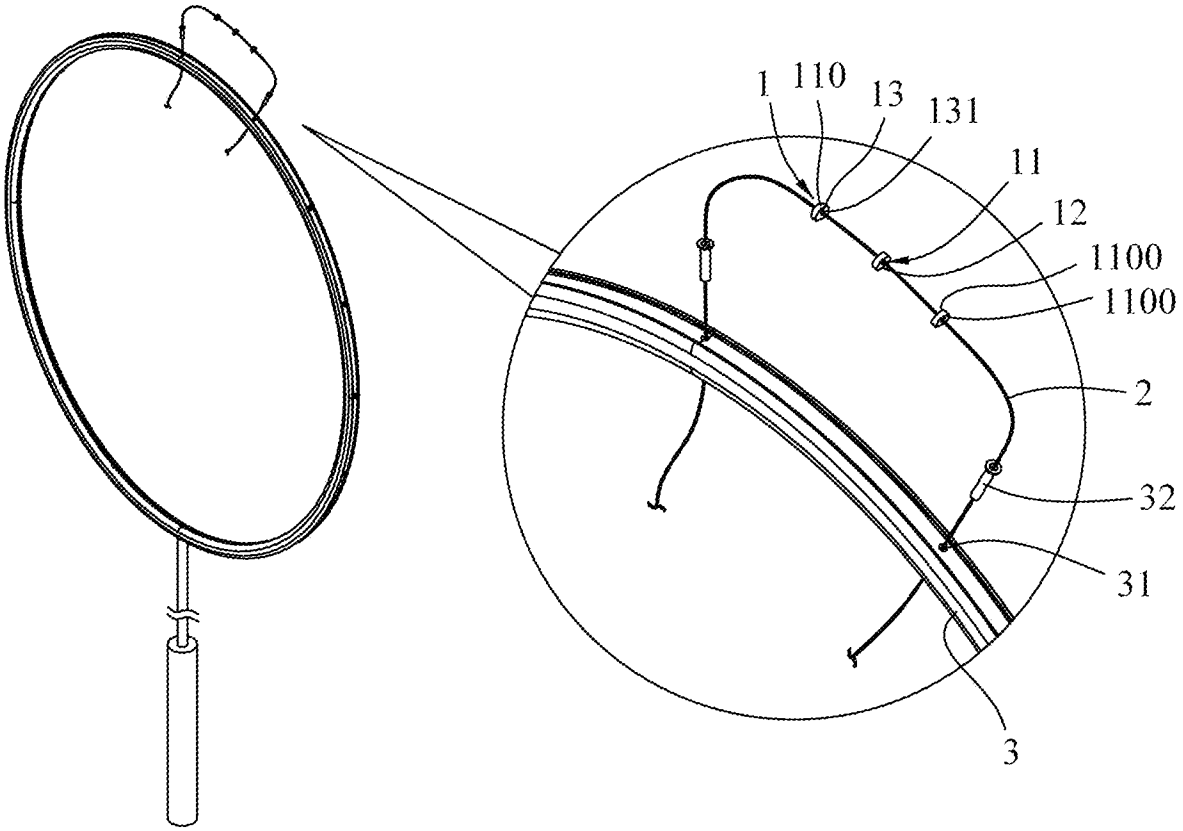
FIG. 2 is an exploded view showing FIG. 1 being assembled with the ball/racket frame having single grommet and the string according to the present invention.
Figure 3:
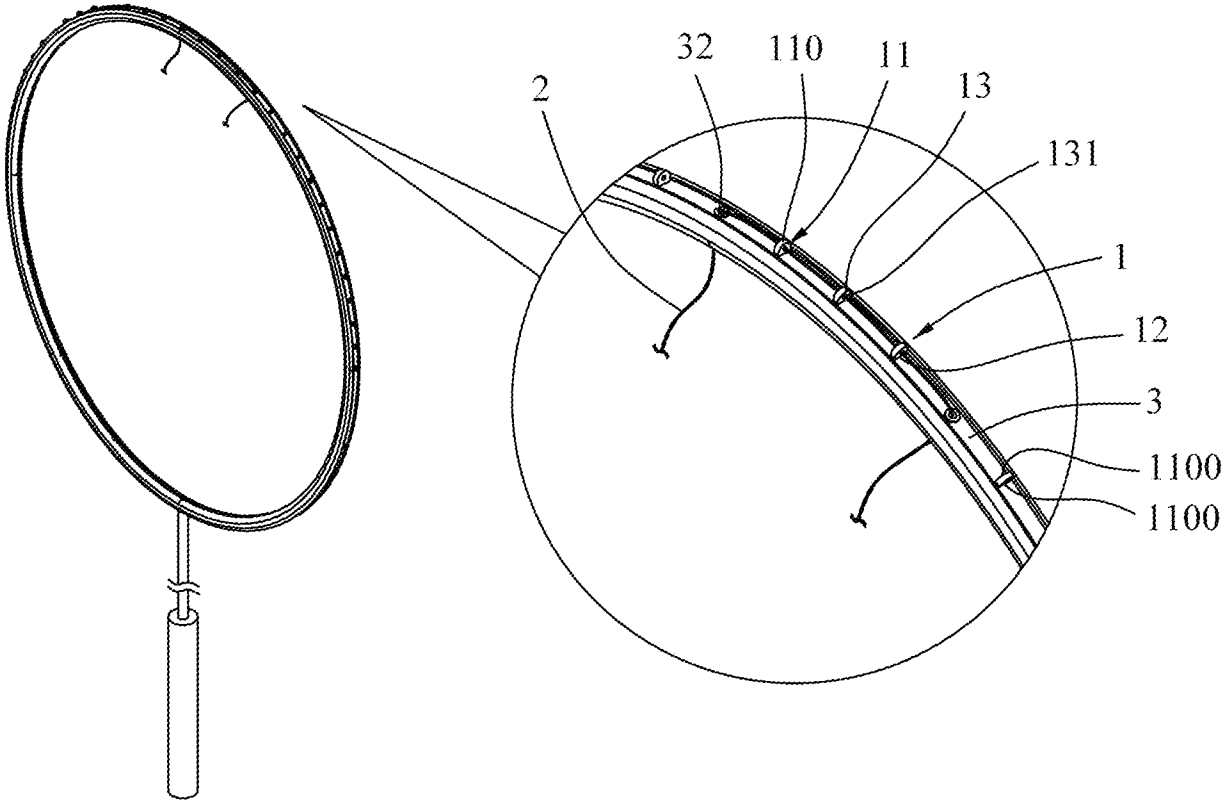
FIG. 3 is a perspective view showing the assembly of FIG. 2 according to the present invention.
Figure 4:
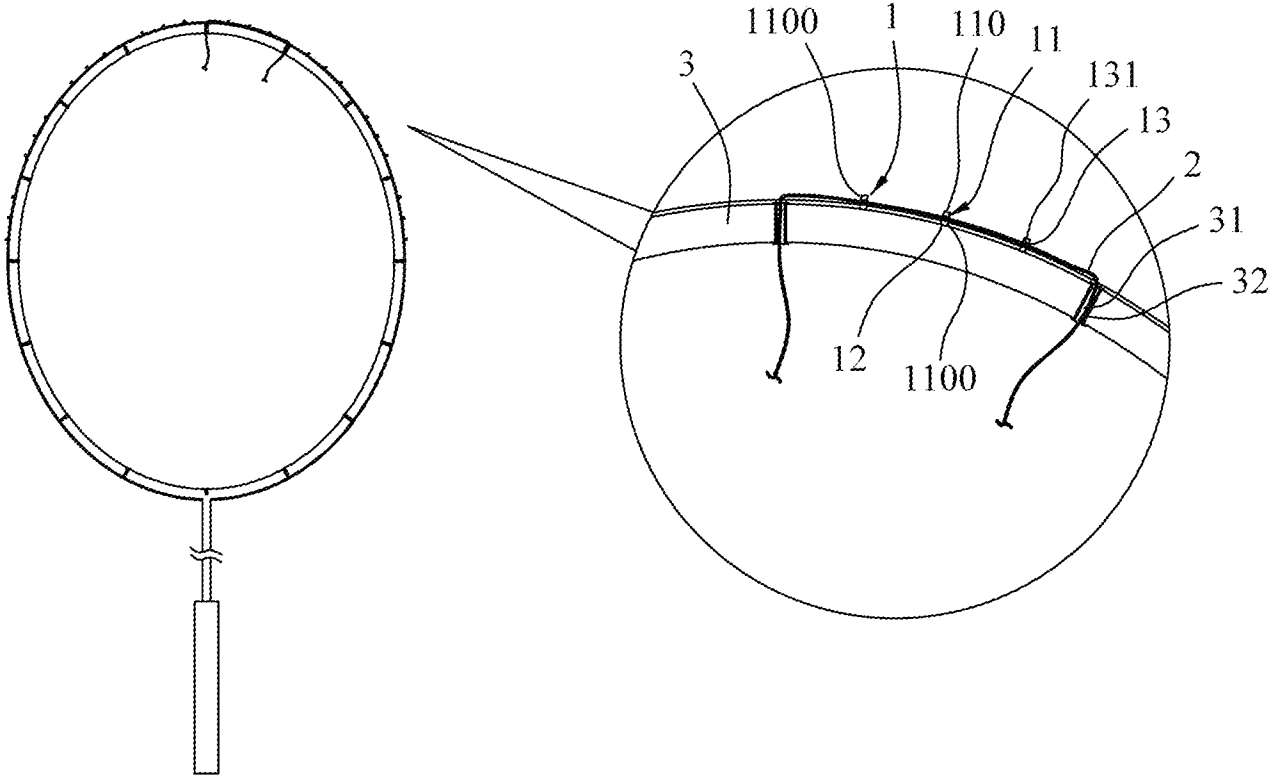
FIG. 4 is a cross sectional view showing the assembly of FIG. 2 according to the present invention.
Figure 5:
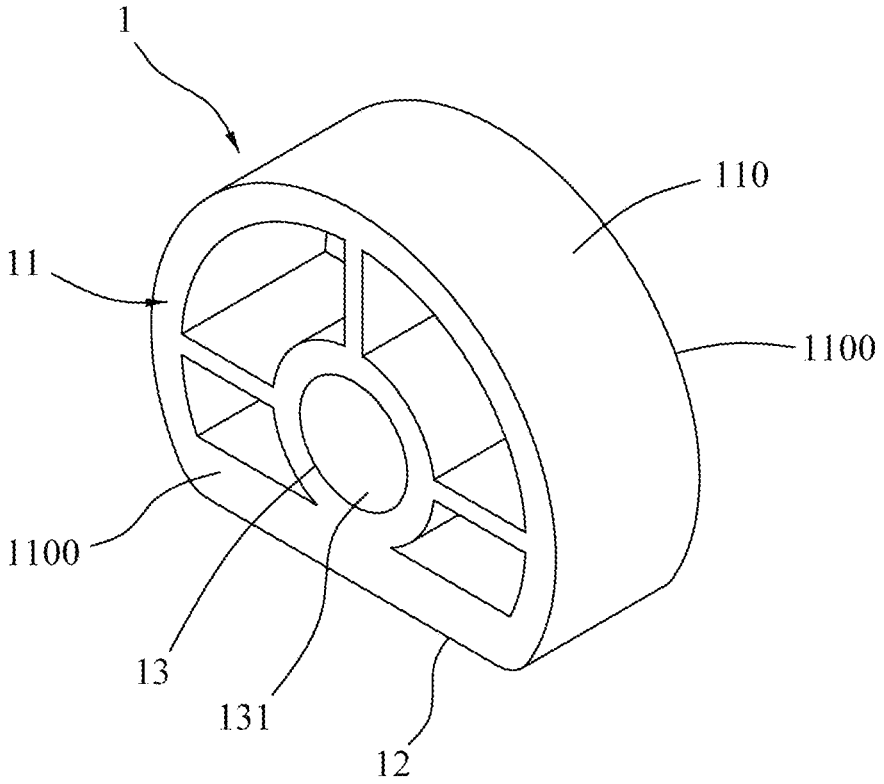
FIG. 5 is a perspective view showing a plurality of hollow arrays being formed through being divided between the outer tubular member and the inner tubular member according to the present invention.
Figure 6:
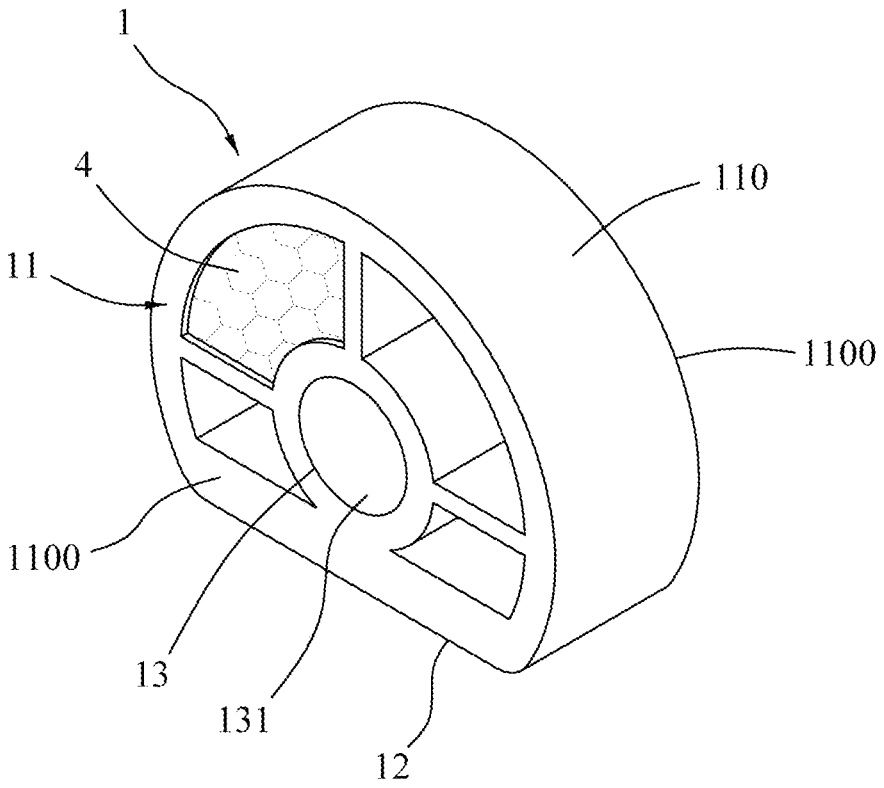
FIG. 6 is a perspective view showing a counterweight being disposed between a horizontal upper end of the outer tubular member and the inner tubular member according to the present invention.
Figure 7:
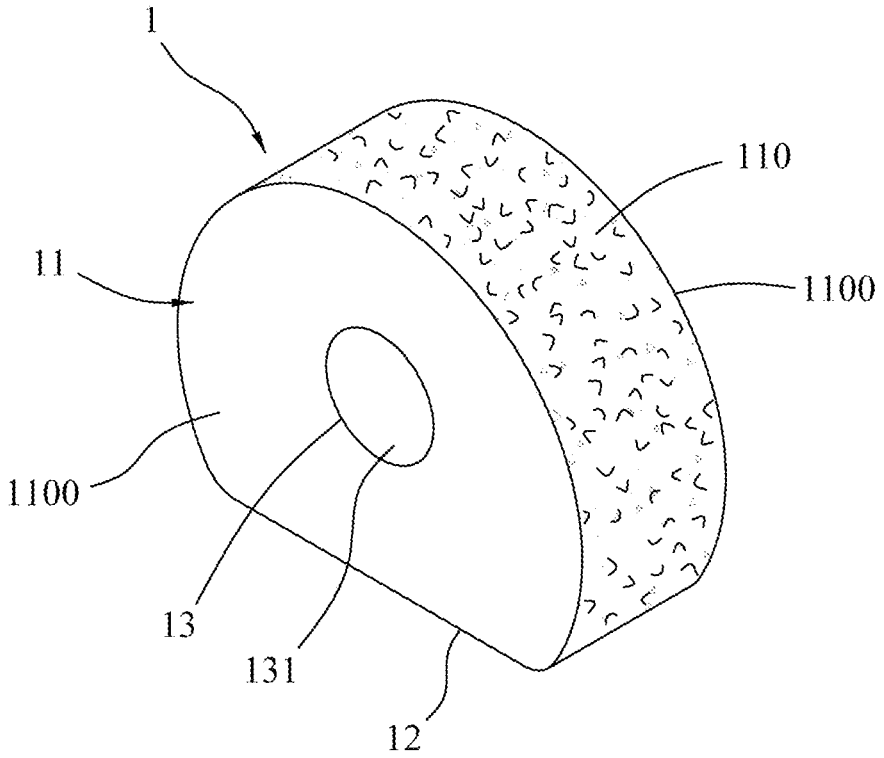
FIG. 7 is a perspective view showing the outer tubular wall at the outer side the outer tubular member being formed as a rough surface according to the present invention.
Figure 8:
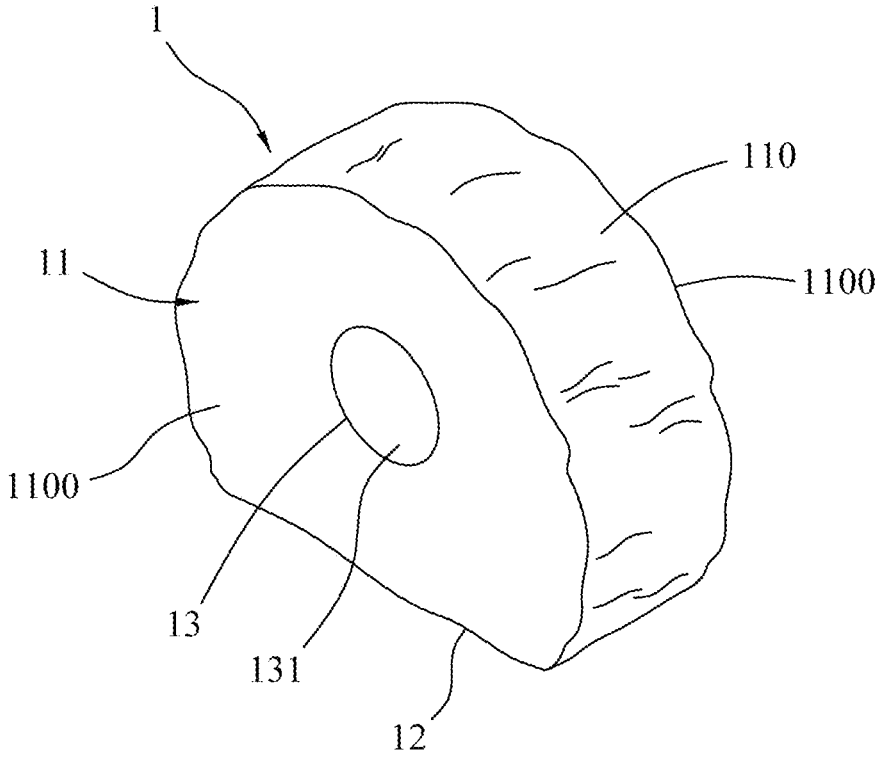
FIG. 8 is a perspective view showing the outer tubular wall of the outer tubular member being formed as an irregular surface according to the present invention.
Figure 9:
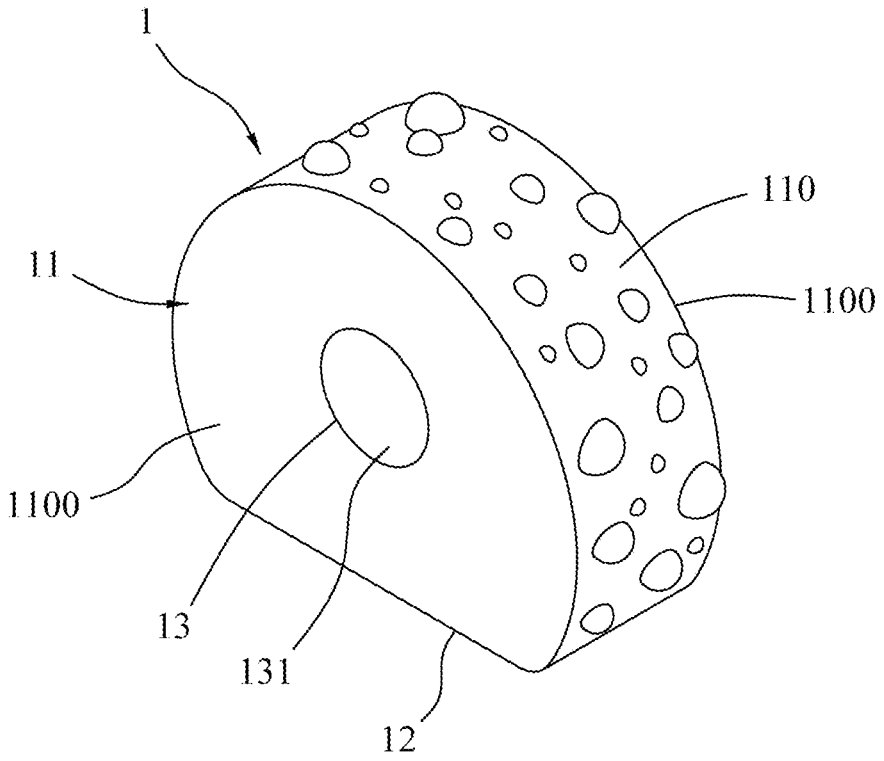
FIG. 9 is a perspective view showing the outer tubular wall of the outer tubular member being provided with a plurality of gel-like protrusions according to the present invention.
Figure 10:
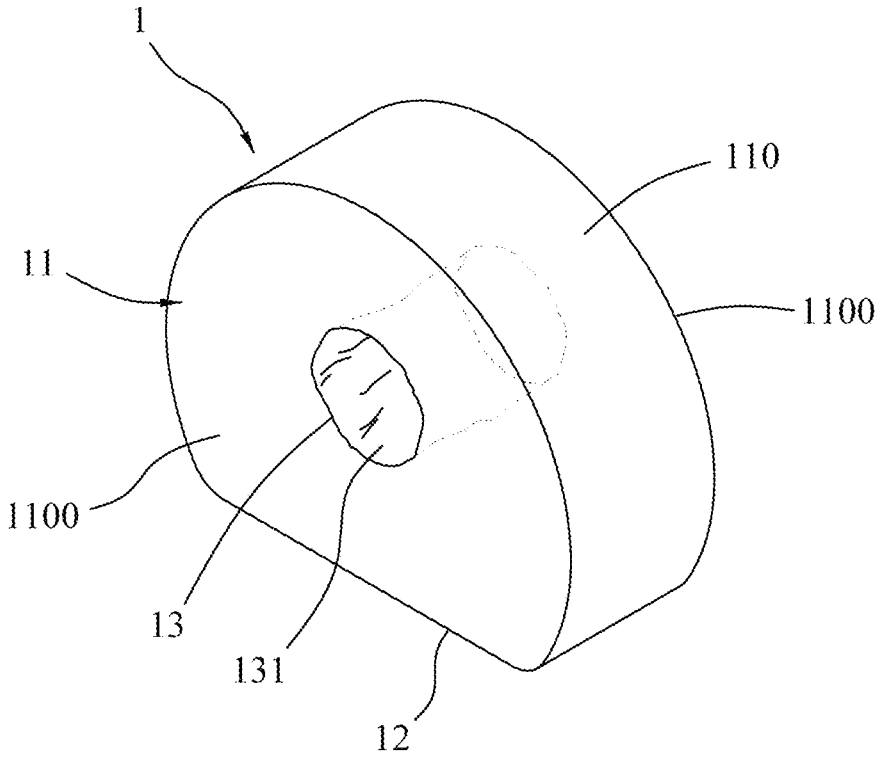
FIG. 10 is a perspective view showing the inner tubular wall of the inner tubular member being formed as an irregular surface according to the present invention.
Figure 11:
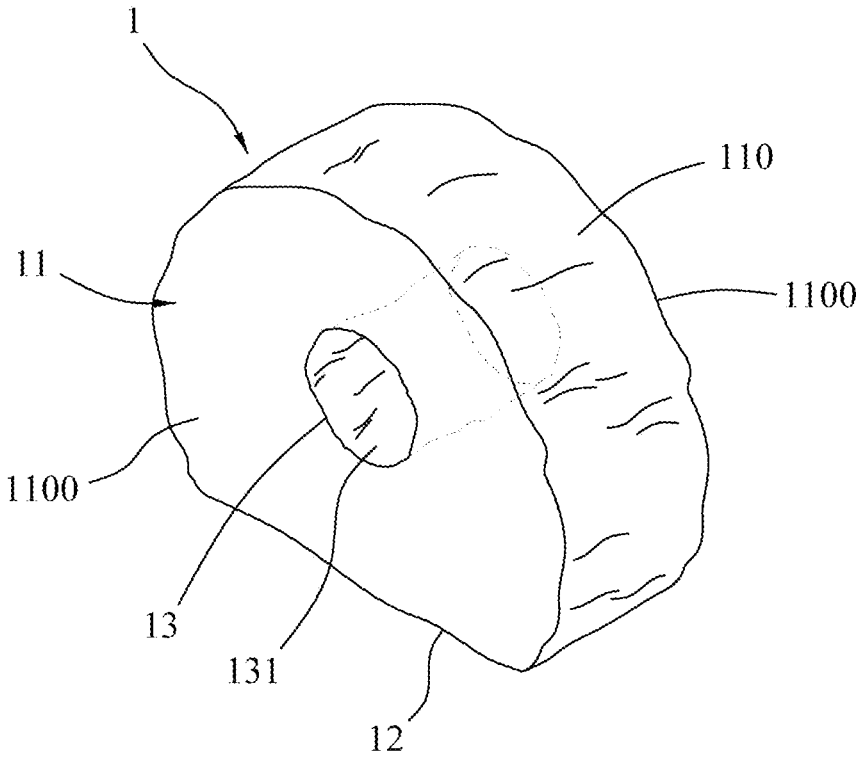
FIG. 11 is a perspective view showing the outer tubular wall of the outer tubular member and the inner tubular wall of the inner tubular member being formed as irregular surfaces according to the present invention.
Figure 12:
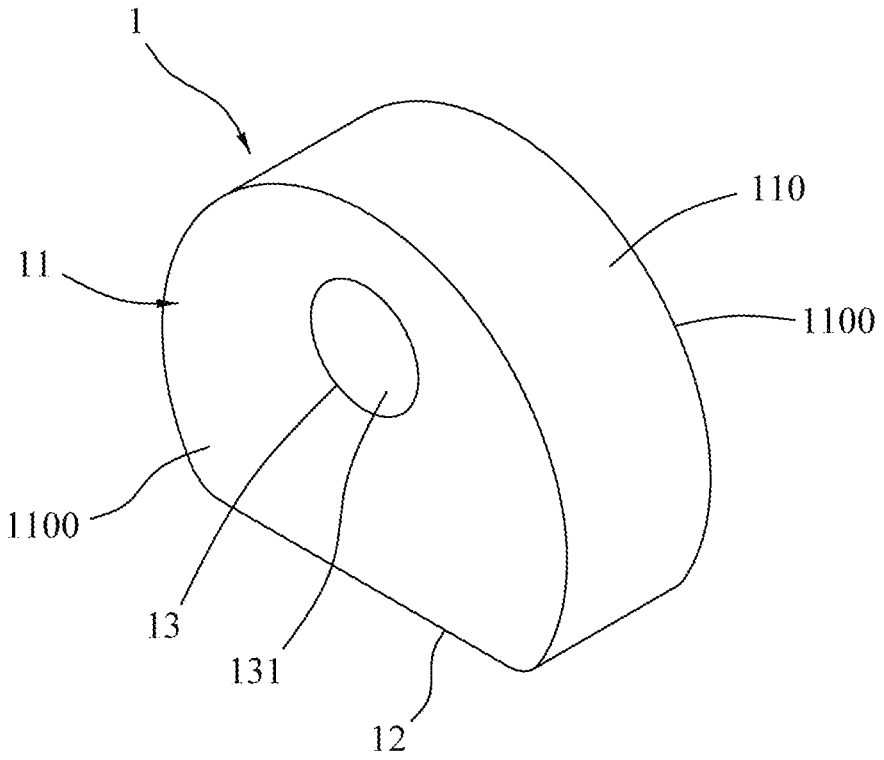
FIG. 12 is a perspective view showing a radial distance ratio defined between the top end of the inner tubular member and the top end of the outer tubular wall of the outer tubular member and between the bottom end of the inner tubular member and the adhering part at the bottom end of the outer tubular member is 1:2 according to the present invention.
Figure 13:
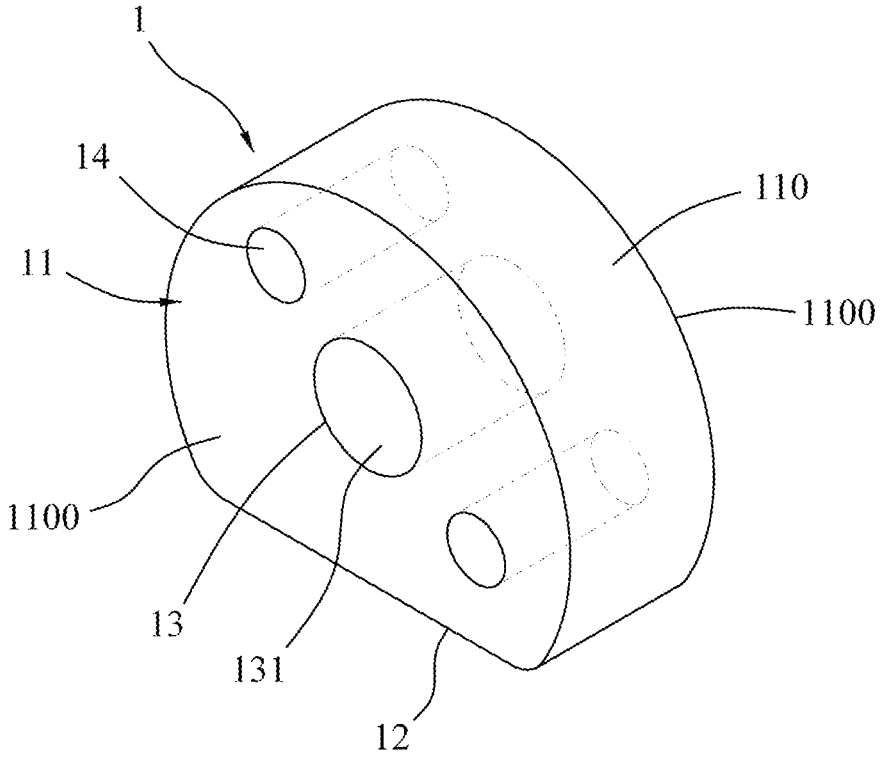
FIG. 13 is a perspective view showing the outer tubular member being formed with at least one axially-oriented hole radially arranged at an interval defined between the inner tubular member and the adhering part according to the present invention.
Figure 14:
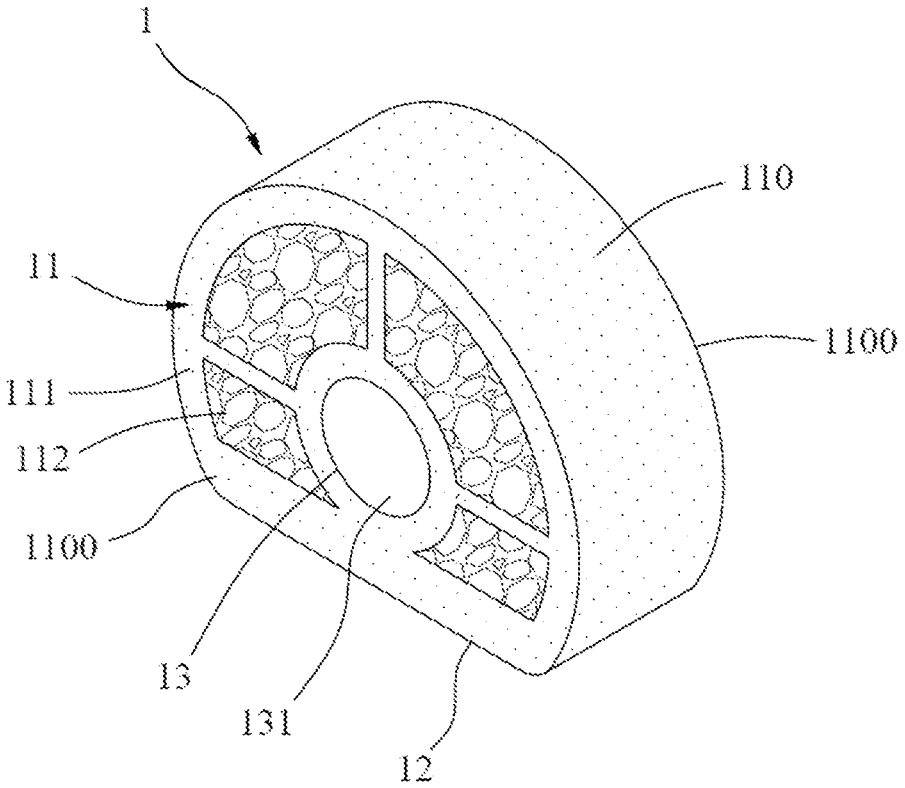
FIG. 14 is a perspective view showing the outer tubular member including a soft medium and a hard medium staggeringly arranged to be integrally formed according to the present invention.
Figure 15:
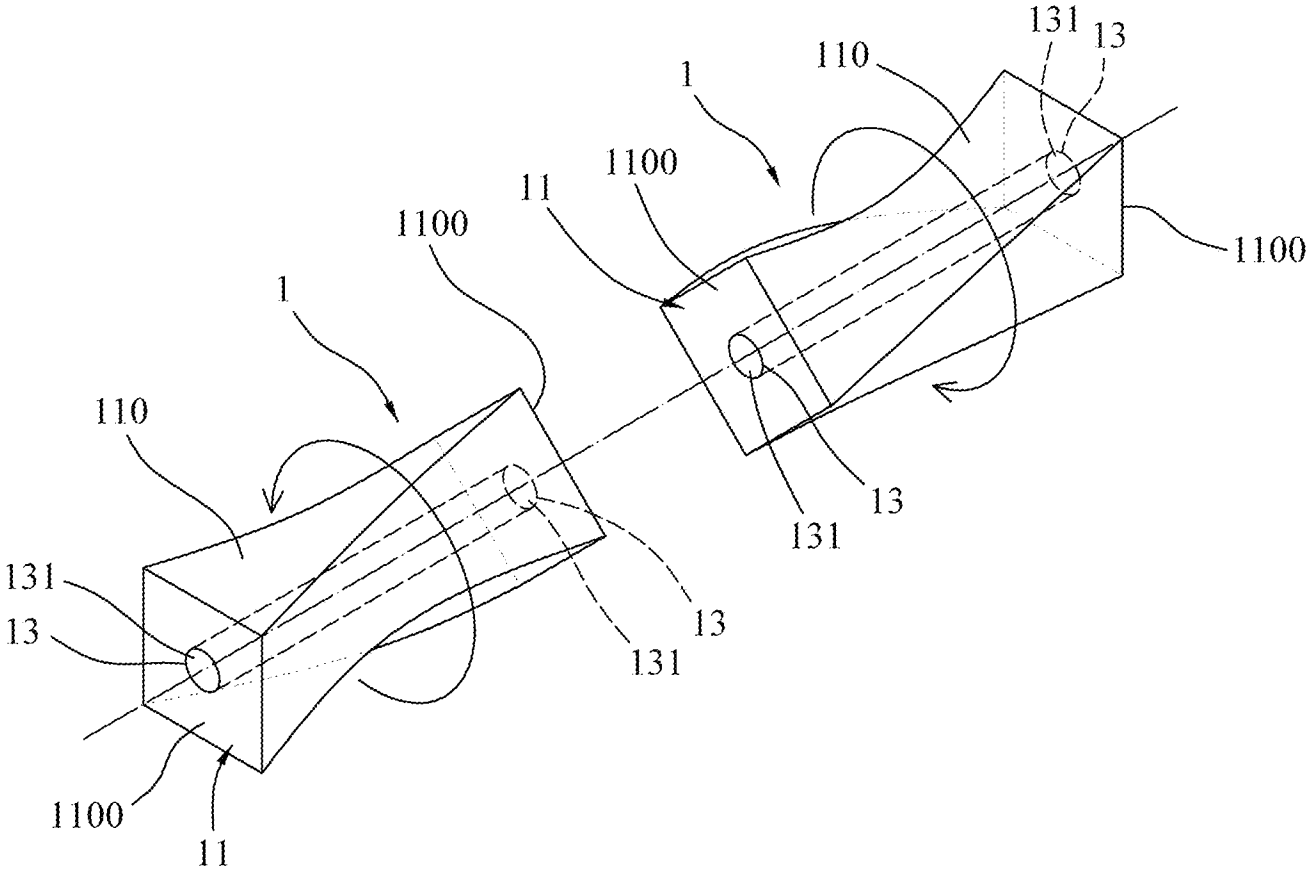
FIG. 15 is a perspective view showing the outer tubular member is formed in a spiral columnar structure composed of at least one set of left spiral columnar state and at least one set of right spiral columnar state according to the present invention.

Please refer from FIG. 1 to FIG. 15, wherein FIG. 1 is a perspective exploded view according to the present invention; FIG. 2 is an exploded view showing FIG. 1 being assembled with the ball/racket frame having single grommet and the string according to the present invention; FIG. 3 is a perspective view showing the assembly of FIG. 2 according to the present invention; FIG. 4 is a cross sectional view showing the assembly of FIG. 2 according to the present invention; FIG. 5 is a perspective view showing a plurality of hollow arrays being formed through being divided between the outer tubular member and the inner tubular member according to the present invention; FIG. 6 is a perspective view showing a counterweight being disposed between a horizontal upper end of the outer tubular member and the inner tubular member according to the present invention; FIG. 7 is a perspective view showing the outer tubular wall at the outer side the outer tubular member being formed as a rough surface according to the present invention; FIG. 8 is a perspective view showing the outer tubular wall of the outer tubular member being formed as an irregular surface according to the present invention; FIG. 9 is a perspective view showing the outer tubular wall of the outer tubular member being provided with a plurality of gel-like protrusions according to the present invention; FIG. 10 is a perspective view showing the inner tubular wall of the inner tubular member being formed as an irregular surface according to the present invention; FIG. 11 is a perspective view showing the outer tubular wall of the outer tubular member and the inner tubular wall of the inner tubular member being formed as irregular surfaces according to the present invention; FIG. 12 is a perspective view showing a radial distance ratio defined between the top end of the inner tubular member and the top end of the outer tubular wall of the outer tubular member and between the bottom end of the inner tubular member and the adhering part at the bottom end of the outer tubular member is 1:2 according to the present invention; FIG. 13 is a perspective view showing the outer tubular member being formed with at least one axially-oriented hole radially arranged at an interval defined between the inner tubular member and the adhering part according to the present invention; FIG. 14 is a perspective view showing the outer tubular member including a soft medium and a hard medium staggeringly arranged to be integrally formed according to the present invention; and FIG. 15 is a perspective view showing the outer tubular member is formed in a spiral columnar structure composed of at least one set of left spiral columnar state and at least one set of right spiral columnar state according to the present invention. According to one preferred embodiment of the present invention, a shock-absorbing device is provided and applied in a ball/racket frame 3 having a plurality of string holes 31 allowing a string 2 to pass, the ball/racket frame 3 may be a frame used in badminton or tennis, but what shall be addressed is that the scope of the present invention is not limited to the above-mentioned arrangement. The string hole 31 of the ball/racket frame 3 has single grommet 32 (as shown in FIG. 2, FIG. 3 and FIG. 4) used for protecting the string 2, but what shall be addressed is that the scope of the present invention is not limited to the above-mentioned arrangement. The device 1 includes at least one or more outer tubular member 11 and an inner tubular member 13.

The at least one outer tubular member 11 is disposed at a periphery of the ball/racket frame 3 and arranged between the string holes 31 adjacently disposed, two sides and an outer side of the outer tubular member 11 are respectively formed with an adhering surface 1100 and an outer tubular wall 110, a bottom end of the outer tubular member 11 is formed with an adhering part 12 adhered at the periphery of the ball/racket frame 3. According to this embodiment, the adhering part 12 is formed in a flat status, what shall be addressed is that the scope of the present invention is not limited to the above-mentioned arrangement, and the adhering part 12 may be formed in any geometrical status. The outer tubular member 11 is formed in a circular shape (as shown in FIG. 1, FIG. 2, FIG. 3 and FIG. 4), in a rectangular shape or in a polygonal shape, but what shall be addressed is that the scope of the present invention is not limited to the above-mentioned arrangement; the appearance of the outer tubular member is formed in a tubular state (as shown from FIG. 1 to FIG. 14) or in a left spiral columnar state or in a right spiral columnar state or a spiral columnar structure composed of at least one set of the left spiral columnar state and at least one set of the right spiral columnar state (as shown in FIG. 15).

The inner tubular member 13 is disposed in the outer tubular member 11 along an axial direction, the inner tubular member 13 allows the string 2 to pass and an inner side of the inner tubular member 13 is formed with an inner tubular wall 131 (as shown in FIG. 1, FIG. 2, FIG. 3 and FIG. 4).

According to the present invention, the outer tubular member 11 includes a soft medium 111 and a hard medium 112 which are staggeringly arranged to be integrally formed (as shown in FIG. 14); a plurality of hollow arrays are formed through being divided between the outer tubular member 11 and the inner tubular member 13 (as shown in FIG. 5); at least one counterweight 4 capable of achieving an effect of absorbing shock through rotating angles is disposed between a horizontal upper end of the outer tubular member 11 and the inner tubular member 13 and arranged with an angle (as shown in FIG. 6); the outer tubular wall 110 of the outer tubular member 11 is formed as a rough surface or a patterned surface (as shown in FIG. 7); the outer tubular wall 110 of the outer tubular member 11 is formed as an irregular surface (as shown in FIG. 8); the outer tubular wall 110 of the outer tubular member 11 is provided with a plurality of gel-like protrusions (as shown in FIG. 9); the inner tubular wall 131 of the inner tubular member 13 is formed as an irregular surface (as shown in FIG. 10); the outer tubular wall 110 of the outer tubular member 11 and the inner tubular wall 131 of the inner tubular member 13 are formed as irregular surfaces (as shown in FIG. 11); a radial distance ratio defined between the top end of the inner tubular member 13 and the top end of the outer tubular wall 110 of the outer tubular member 11 and between the bottom end of the inner tubular member 13 and the adhering part 12 at the bottom end of the outer tubular member 11 is 1:1 (as shown in FIG. 1) or 1:2 (as shown in FIG. 12); the outer tubular member 11 is formed with at least one axially-oriented hole 14 radially arranged at an interval defined between the adhering part 12 and the inner tubular member 13 (as shown in FIG. 13). With a means of sequentially disposing one or more than one of the devices 1 between every two of the adjacent string holes 31 of the ball/racket frame 3, the adjacent adhering surfaces 1100 are able to be mutually adhered for being integrally formed as one piece; with a means of arranging weighs or counterweights in different phases through rotating in different angles, the string 2 can be prohibited from being in the same horizontal plane, thus providing interferences at different timings and bearing shock waves of a counter shock force generated while a ball being struck via the string 2 can achieve effects of absorbing shock and damping.

According to the present invention, the outer tubular member 11 of the device 1 is structured through the soft medium 111 and the hard medium 112 being staggeringly arranged for being integrally formed and the periphery thereof is formed with the outer tubular wall 110, the bottom end of the outer tubular member 11 is formed with the adhering part 12, and the outer tubular member 11 is axially disposed with the inner tubular member 13 served as a string passing hole and having the inner tubular wall 131; as such, one or more than one of the devices 1 are disposed at the periphery of the ball/racket frame 3 to generate the weights in different phases, and the string 2 passing the inner tubular wall 131 is disposed in the adjacent string hole 31 of the ball/racket frame 3, thereby providing interferences at different timings and bearing shock waves of a counter shock force generated while a ball being struck via the string 2, and effects of absorbing shock and damping are achieved; moreover, the structure can be greatly simplified, the racket operation can be safer, the stability of holding the racket can be enhanced and possible sport damages can be lowered. Accordingly, the present invention can be widely applied in sport related industries and has features of being novel and nonobvious.

Based on what have been disclosed above, while this present invention has been described by means of specific embodiments, numerous modifications and variations could be made thereto by those skilled in the art without departing from the scope and spirit of the present invention set forth in the claims.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific examples of the embodiments disclosed and that modifications and other embodiments are intended to be included within the scope of the appended claims. Although specific terms are employed herein, they are used in a generic and descriptive sense only and not for purposes of limitation.

What is claimed is:

1. A shock-absorbing device for use with a racket frame having a plurality of string holes, the shock-absorbing device comprising:

at least one or more outer tubular member located on an outer periphery of a racket frame and positioned between two adjacent string holes of the plurality of string holes of the racket;

each outer tubular member of the at least one or more outer tubular member has an adhering part, an outer tubular wall, two adhering surfaces, and an inner tubular member;

the adhering part is located on a bottom of the outer tubular member and adhered to the outer periphery of the racket frame;

the outer tubular wall is a curved surface located on an outer periphery of the outer tubular member and is connected to opposing ends of the adhering part;

the two adhering surfaces define front and rear surfaces of the outer tubular member respectively and are flat surfaces connected to the adhering part and the outer tubular wall; and the inner tubular member extends through the outer tubular member along an axial direction and has an inner tubular wall;

wherein, when the at least one or more outer tubular member is located on the outer periphery of the racket frame, a string is inserted through a first string hole of the two adjacent string holes of the plurality of string holes of the racket, through the at least one or more outer tubular member, and through a second string hole of the two adjacent string holes of the plurality of string holes of the racket, the at least one or more outer tubular member is spaced apart from the two adjacent string holes of the plurality of string holes of the racket;

wherein, when the at least one or more outer tubular member is located on an outer periphery of the racket frame, the string is prohibited from being in a same horizontal plane, thereby providing interferences at different timings and bearing shock waves of a counter shock force are generated when a ball is struck by the string, and effects of absorbing shock and damping are achieved.

2. The shock-absorbing device as claimed in claim 1, wherein the outer tubular member includes a softer medium and a harder medium staggeringly arranged to be integrally formed.

3. The shock-absorbing device as claimed in claim 1, wherein a hollow array is formed through being divided between the outer tubular member and the inner tubular member.

4. The shock-absorbing device as claimed in claim 1, wherein at least one counterweight capable of achieving an effect of absorbing shock through rotating angles is disposed between a horizontal upper end of the outer tubular member and the inner tubular member and arranged with an angle.

5. The shock-absorbing device as claimed in claim 1, wherein the outer tubular wall of the outer tubular member is formed as a patterned surface.

6. The shock-absorbing device as claimed in claim 1, wherein the outer tubular wall of the outer tubular member is provided with a plurality of protrusions.

7. The shock-absorbing device as claimed in claim 1, wherein the outer tubular member is formed with at least one axially-oriented hole radially arranged at an interval defined between the adhering part and the inner tubular member.

8. The shock-absorbing device as claimed in claim 1, wherein the appearance of the outer tubular member is formed in a tubular state or in a left spiral columnar state or in a right spiral columnar state or a spiral columnar structure composed of at least one set of the left spiral columnar state and at least one set of the right spiral columnar state.

9. The shock-absorbing device as claimed in claim 1, wherein, when the at least one or more outer tubular member located on an outer periphery of the racket frame, a grommet is located in each string hole and the string passes through a corresponding grommet.

* * * * *